US008776842B2

(12) United States Patent
Clüsserath

(10) Patent No.: US 8,776,842 B2
(45) Date of Patent: Jul. 15, 2014

(54) METHOD OF TREATING A BEVERAGE BOTTLE FILLING MACHINE IN A BEVERAGE BOTTLING PLANT, METHOD OF CLEANING A CONTAINER FILLING MACHINE IN A CONTAINER FILLING PLANT, AND ARRANGEMENTS THEREFOR

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 1023 days.

(21) Appl. No.: 12/614,296

(22) Filed: Nov. 6, 2009

(65) Prior Publication Data

US 2010/0108180 A1 May 6, 2010

Related U.S. Application Data

(63) Continuation-in-part of application No. PCT/EP2008/003403, filed on Apr. 26, 2008.

(30) Foreign Application Priority Data

May 9, 2007 (DE) ..... 10 2007 022 259

(51) Int. Cl.
*B65B 1/04* (2006.01)
*B67C 3/00* (2006.01)

(52) U.S. Cl.
CPC ..... *B67C 3/001* (2013.01)
USPC ..... 141/91; 141/89; 141/90; 222/148

(58) Field of Classification Search
USPC ..... 141/89, 90, 91; 222/148
See application file for complete search history.

(56) References Cited

U.S. PATENT DOCUMENTS

| | | | | |
|---|---|---|---|---|
| 5,402,833 | A * | 4/1995 | Clusserath | 141/39 |
| 7,513,279 | B2 * | 4/2009 | Bernhard et al. | 141/90 |
| 8,261,783 | B2 * | 9/2012 | Macquet et al. | 141/90 |
| 8,387,668 | B2 * | 3/2013 | Macquet et al. | 141/91 |
| 2005/0172580 | A1 * | 8/2005 | Krulitsch | 53/471 |
| 2005/0188654 | A1 | 9/2005 | Clusserath et al. | |
| 2005/0198921 | A1 * | 9/2005 | Clusserath | 53/136.1 |
| 2005/0217753 | A1 | 10/2005 | Krulitsch | |
| 2005/0241726 | A1 | 11/2005 | Clusserath et al. | |
| 2009/0095370 | A1 * | 4/2009 | Krulitsch | 141/6 |

FOREIGN PATENT DOCUMENTS

| | | | |
|---|---|---|---|
| DE | 100 61 401 | A1 | 6/2002 |
| DE | 10 2004 004 331 | B3 | 9/2005 |
| DE | 10 2004 017 205 | A1 | 10/2005 |
| EP | 1 544 155 | A | 6/2005 |
| EP | 1 571 119 | A | 9/2005 |
| EP | 1 580 160 | A | 9/2005 |
| WO | WO 2007/118607 | A | 10/2007 |

* cited by examiner

*Primary Examiner* — Timothy L Maust
(74) *Attorney, Agent, or Firm* — Nils H. Ljungman & Associates

(57) ABSTRACT

A container filling arrangement and a method of operating a container filling arrangement, which container filling arrangement comprises a filling element, a closure element, a supply of cleaning and/or sterilization medium, and a control element. During a cleaning and/or sterilizing operation of the filling element, cleaning and/or sterilization medium is conducted from the supply of cleaning and/or sterilization medium to the filling element. The control element is operatively connected to the closure element and is actuatable, by fluid pressure of the cleaning and/or sterilization medium in the filling element, to increase the force of engagement of the closure element during the cleaning and/or sterilizing operation.

20 Claims, 6 Drawing Sheets

METHOD OF TREATING A BEVERAGE BOTTLE FILLING MACHINE IN A BEVERAGE BOTTLING PLANT, METHOD OF CLEANING A CONTAINER FILLING MACHINE IN A CONTAINER FILLING PLANT, AND ARRANGEMENTS THEREFOR

CONTINUING APPLICATION DATA

This application is a Continuation-In-Part application of International Patent Application No. PCT/EP2008/003403, filed on Apr. 26, 2008, which claims priority from Federal Republic of Germany Patent Application No. 10 2007 022 259.0, filed on May 9, 2007. International Patent Application No. PCT/EP2008/003403 was pending as of the filing date of this application. The United States was an elected state in International Patent Application No. PCT/EP2008/003403.

BACKGROUND

1. Technical Field

The present application pertains to a free-stream filling system for filling machines for filling of bottles or similar containers with a liquid product. The free-stream filling system comprises a filling element, in whose housing is provided a liquid channel controlled by at least one liquid valve and forming at least one dispensing opening, in which is arranged at least one gas lock after the at least one liquid valve in the flow direction of the liquid product during the filling and through which the liquid product flows during the filling. The free-stream filling system also comprises a holder on which a closure element closing the dispensing opening for a cleaning and/or sterilization operation is or can be secured. The free-stream filling system also comprises means for pressing the closure element against the filling element. The present application also relates to a method for control of such a filling system.

2. Background Information

Background information is for informational purposes only and does not necessarily admit that subsequently mentioned information and publications are prior art.

Filling systems for use at filling machines for the filling of bottles or similar containers with a liquid product are known in various configurations. It is also known how to close the respective filling element at its dispensing opening for a cleaning and/or sterilization (CIP cleaning and/or sterilization) by a closure element, such as a rinse cap or rinse plate, thereby forming a rinse chamber through which the generally liquid cleaning and/or sterilization medium can flow. It is also known how to provide a control space subjected to fluid pressure in the filling element, into which a fluid channel empties that is open in the region of the dispensing opening, and which is part of a pressure-activated control element, by which the closure element can be pressed by the pressure of the rinse and/or sterilization medium tightly against the filling element. This mode of operation thus far could not be used with free-stream filling systems.

Free-stream systems in the sense of the present application are filling systems with which a filling of bottles or similar containers occurs in that the liquid product flows in a free stream to the container.

Such free-stream filling systems are characterized in that the container does not come in contact with the filling element. Furthermore, the return gas during the filling process escapes from the container through the space between container and filling element into the surroundings, so that in the free-stream filling process, other than the product flow pathway, basically no other flow pathway needs to be opened. Furthermore, the product flow cannot be influenced by a return gas regulating system, but only as a rule by the setting of the product valve.

OBJECT OR OBJECTS

An object of the present application is to provide a free-stream filling system in which a sealed-off pressing of the closure element against the filling element is possible during the cleaning and/or sterilization mode (CIP cleaning and/or sterilization) by the pressure of the cleaning or sterilization medium prevailing in the control space.

SUMMARY

To solve this problem, the present application discloses a free-stream filling system for filling machines for filling of bottles or similar containers with a liquid product. The free-stream filling system comprises a filling element, in whose housing is provided a liquid channel controlled by at least one liquid valve and forming at least one dispensing opening, in which is arranged at least one gas lock after the at least one liquid valve in the flow direction of the liquid product during the filling and through which the liquid product flows during the filling. The filling system additionally comprises a holder on which a closure element closing the dispensing opening for a cleaning and/or sterilization operation is or can be secured, and also with means for pressing the closure element against the filling element. The means for pressing the closure element are formed by a control element with a control space subjected to a fluid pressure into which a fluid channel empties that is open in the region of the dispensing opening. At least a first controlled flow pathway is formed in the filling element housing, including the fluid channel and the control space, which leads to a first collecting channel in common to the filling elements or several filling elements of the filling machine. The fluid channel and control space can be closed during the filling operation and opened during the cleaning and/or sterilization operation. The present application also discloses a method for control of the filling system.

In the filling system according to the present application, the gas or flow pathway formed by the fluid channel, the control space and the "first" flow channel is closed during the normal filling process, i.e., during the free-stream filling, so that neither liquid product can get into this gas or flow pathway, nor can air be sucked in and entrained by the liquid product emerging from the dispensing opening through this gas or flow pathway. During the cleaning and/or sterilization mode (CIP cleaning and/or sterilization), the aforementioned gas or flow pathway is opened, so that the cleaning and/or sterilization medium can also flow through the control space and at the same time the required and/or desired pressing force for the closure element (e.g., rinse cap or rinse plate) is produced by the pressure of the cleaning and/or sterilization medium building up in the control space.

Further configurations, benefits and application possibilities of the present application will also emerge from the following description of sample embodiments and from the figures. The features described and/or graphically represented in themselves or in any given combination are essentially the subject of the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application shall be explained more closely hereafter by means of the figures and sample embodiments. There are shown.

DESCRIPTION OF EMBODIMENT OR EMBODIMENTS

Figure 1:
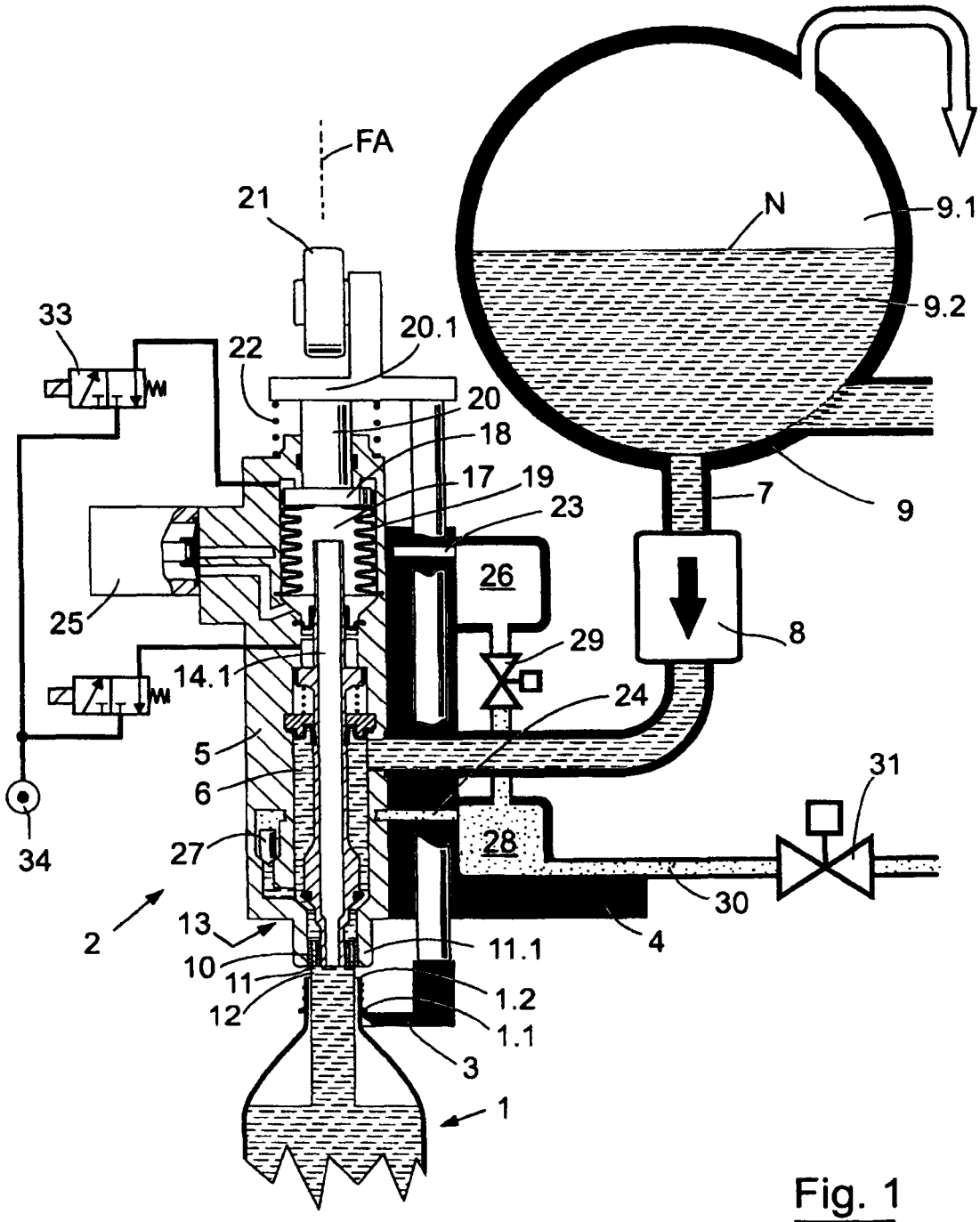
FIG. 1 shows a free-stream filling system according to the present application in an operating state corresponding to a fast filling phase.
Figure 2:
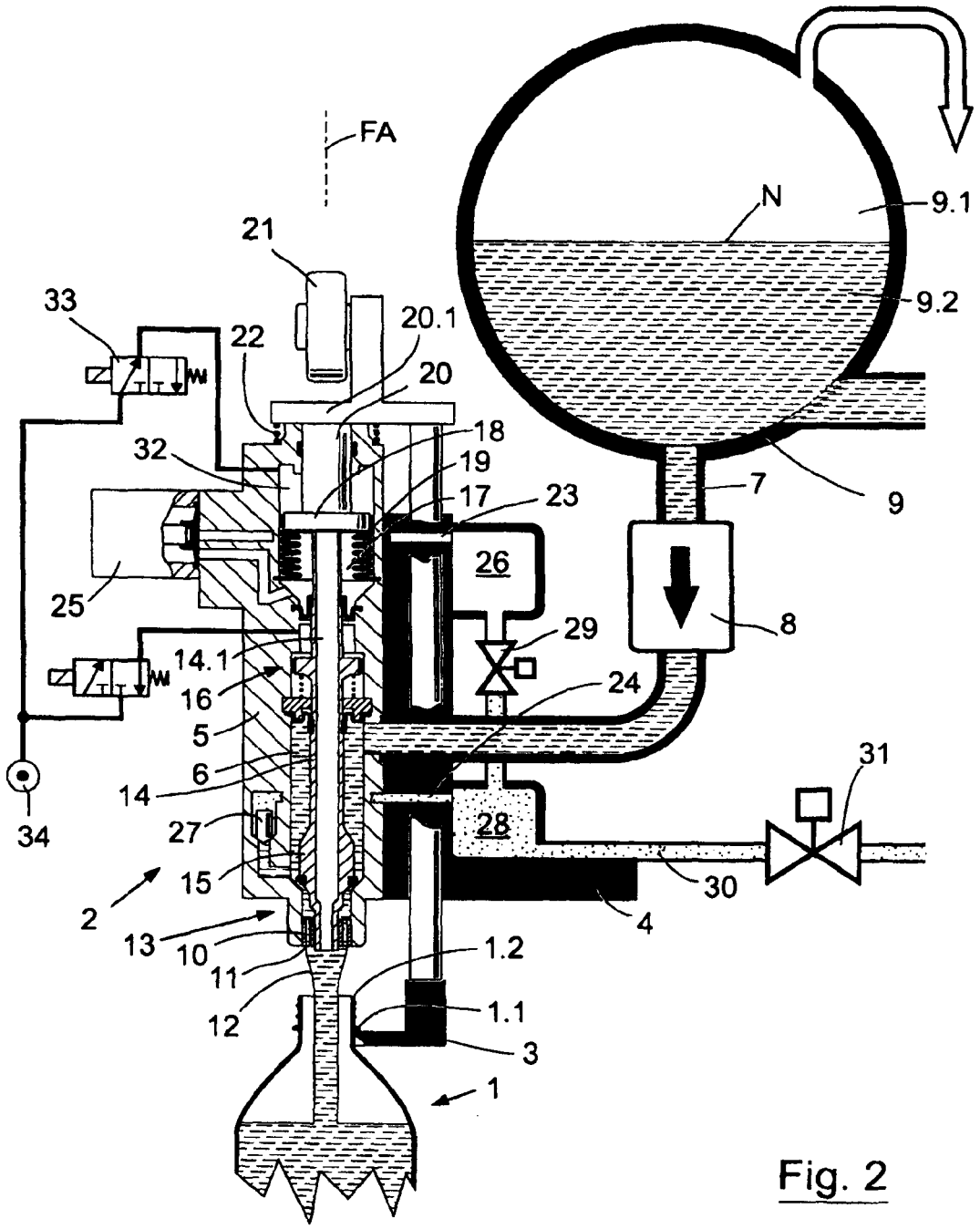
FIG. 2 shows a free-stream filling system according to the present application in an operating state corresponding to a slow filling phase.

The free-stream filling system depicted in FIGS. 1 and 2 is part of a filling machine, such as a filling machine of rotary design for free-stream filling of bottles 1 or other containers with a liquid product. The filling system comprises a filling element 2, which is provided along with several identical filling elements 2 and coordinated bottle or container holders 3, from which the bottles 1 being filled are suspended by a mouth flange 1.1 during the filling process, at the periphery of a rotor 4 which can be driven in rotation about a vertical axis of the machine.

In the housing 5 of each filling element 2 there is formed a liquid channel 6, which is connected by its upper end via a conduit 7 with flow meter 8 to a kettle 9 provided on the rotor 4 in common for the filling elements 2. The kettle 9 is filled with the liquid product under control up to a level N for the operation of the filling machine, so that a gas space 9.1 is formed in the kettle 9 above the level of liquid product, and beneath it a liquid tree 9.2, into which the conduits 7 empty.

The liquid channel 6 forms at its bottom a dispensing opening 11 provided with a gas lock 10, across which the liquid product flows as a free stream 12 during the free-stream filling of the respective bottle 1, with the bottle mouth 1.2 at a distance from the dispensing opening 11.

In the liquid channel 6, upstream from the gas lock 10 in the flow direction of the liquid product, there is provided a liquid valve 13, which in the embodiment depicted is formed by a valve plunger in the form of a pipe piece 14 with valve body 15, cooperating with a valve seat in the liquid channel 6. The liquid valve 13 is opened and closed by an activating device 16 through the pipe piece 14, open at both ends and arranged coaxially with the vertical axis FA of the filling element for a volume-controlled filling in accordance with the signal from the flow meter 8.

The channel 14.1 formed inside the pipe piece 14 is open at the dispensing opening 11 and surrounded there by the gas lock 10, which in the embodiment depicted is formed by a ring-shaped insert with a plurality of individual channels open at both ends and oriented parallel or substantially parallel to each other and parallel and/or substantially parallel to the axis FA. Furthermore, the channel 14.1 empties into a control space 17 formed in the housing 5 and closed off from the outside, being bounded at the top by a piston 18 and at the side by a bellows 19. The piston 18 is provided at the top of the housing 5, able to move axially by a predetermined maximum stroke in the direction of the axis FA by means of a piston rod 20. The end 20.1 of the piston rod 20 led out from the housing 5 and provided with a cam roller 21 is connected by a rod assembly to the container holder 3. By the cam roller 21 and a control cam (not shown), the container holder 3 can be lowered in controlled manner against the force of a compression spring 22. The gas lock 10 is provided, e.g., on the pipe piece 14 and movable with this opening and closing of the liquid valve 13 in the direction of the axis FA, or when the gas lock 10 is provided firmly on the filling element housing 5 the pipe piece 14 is arranged or guided to be axially movable by its lower end into the gas lock 10.

Inside the housing 5 of the filling element 2 are formed two flow channels 23 and 24 in the depicted embodiment, of which the flow channel 23 has an electrically operated valve 25 and thus forms a controlled connection between the control space 17 and an annular channel 26 on the rotor 4 for the filling elements 2 of the filling machine or in common to a group of filling elements.

The flow channel 24 is provided with a check valve 27 and connects the liquid channel 6 in the flow direction immediately upstream or upstream from the liquid valve 13 or the valve seat of this liquid valve to an annular channel 28 on the rotor 4 for the filling elements 2 or in common to a group of filling elements 2. The check valve 27 is designed so that it opens for a flow from the liquid channel 6 into the annular channel 28 but closes for a flow in the opposite direction. Thanks to an electrically operated valve 29, the two annular channels 26 and 28 can be joined together or separated from each other in controlled manner. On the annular channel 28, a conduit 30 is hooked up to a control valve 31.

Above the piston 18, a piston or cylinder space 32 (FIG. 3) is formed inside the housing 5, which can be subjected to the pressure of a pressurized air source 34 in controlled fashion via an electrically operated control valve 33.

The most diverse modes of operation are possible with the filling system and filling element 2.

First, a free-stream filling of the bottles 1 with the liquid product in a fast filling phase is possible in the operating mode shown in FIG. 1. For this, with valves 25, 29 and 31 closed and annular channel 28 in one possible embodiment subjected to pressure, the liquid valve 13 is opened so that the liquid product can flow in free stream to the bottle 1 suspended from the container holder 3, until the filling process is ended by closing of the liquid valve 13.

By activating the control valve 33, the cylinder space 32 can be subjected to pressure, thereby moving the piston 18 downward to a bottom stroke position, defined by the striking of the end 20.1 against the top of the housing 5. The piston 18 in this position forms an end stop for the upper end of the pipe piece 14. This stop is adjusted so that the liquid valve 13 can be opened or may be opened by the activating element 16 with a reduced valve gap for a slow filling, i.e., for a slow filling phase, as shown in FIG. 2. The size of the valve gap of the liquid valve 13 and, thus, of the volume flow of the liquid product in the slow filling phase can be adjusted by the position of the piston 18 when the cylinder space 32 is subjected to pressure, for example, by an appropriate setting of the upper end 20.1 of the piston rod 20 and/or an end stop for this end at the housing side.

Because the flow channel 23 is closed by the control valve 25, no liquid product can get into the channel 14.1 during the filling and/or no air can be sucked in and entrained by the liquid product from the channel 14.1. This also prevents, restricts, and/or minimizes excessive frothing during the filling, or excessive air and oxygen becoming incorporated in the bottled product.

The described configuration furthermore enables a keeping warm or heating of the filling elements 2 during fill intermissions, in one possible embodiment during the time between the ending of one filling phase and the beginning of a new filling phase, and this by a circulating of the hot liquid product (hot circulation). For this, the kettle 9 and also the annular channel 28 and the conduit 30 with the valve 31 opened forms a circulation provided with a circulating and heating mechanism for the liquid product, in which the hot liquid product flows to each filling element 2 or the liquid channel 6 there across the conduit 7, even when the liquid valve 13 is closed, and is taken back to the kettle 9 from the liquid channel 6 via the flow channel 24, the annular channel 28 and the conduit 30 with the valve 31 opened.

Yet the described embodiment also enables, in one possible embodiment, a cleaning and sterilization of the channels of the filling elements of the filling machine, including the annular channels 26 and 28 and the conduit 30 (FIG. 3), and this by using simple rinse plates 35, which are manually or automatically inserted for the CIP cleaning and/or sterilization such that each rinse plate 35 is located under each filling element 2 or the dispensing opening 11 there, and each filling element 2 is pressed by a ring-shaped bottom edge 11.1 encircling the dispensing opening 11 against a sealing ring 36 provided on the top of the rinse plate 35 and forms a tight seal. In this way, a rinse space 37 sealed off against the outside is formed within each sealing ring 36, into which the dispensing opening 11 or the gas lock 10, but also the lower, open end of the channel 14.1 emerges. For the CIP cleaning and/or sterilization, when the cylinder space 32 is pressureless, the control valve 25 and the valves 29 and 31, as well as the liquid valve 13, are opened, so that the cleaning and sterilization medium supplied from the kettle 9 via the conduits 7 flows per arrows A of FIG. 3 through the channels of each filling element 2, as well as the annular channels 26 and 29, the conduit 30 and the control valves 25, 29 and 31. The cleaning and sterilization medium also gets into the control space 17 via the channel 14.1, so that the rinse plate 35 held against the container holder 3 is tightly pressed against the edge 11.1 surrounding the dispensing opening 11 by the pressure of the cleaning and sterilization medium exerted on the piston 18, in addition to the pressure of the compression spring 22.

In at least one possible embodiment of the present application, the filling element 2, kettle or reservoir 9, and the channels and valves of the filling element 2 may be cleaned or sterilized or treated. To begin this process, the filling element 2 and the reservoir 9 may be emptied of any liquid beverage material. A rinse plate 35 with a cleaning ring 36 may then be slid into sealing engagement with respect to the dispensing opening 11. The cylinder space 32 may be pressureless, and the valves 13, 25, 29, and 31 may be opened. A cleaning liquid or sterilization medium may then be introduced into the reservoir. The quantity of cleaning medium introduced may be sufficient to clean and/or sterilize and/or treat the reservoir 9, each of the filling elements 2 disposed on the rotor 4, and each channel and valve of each filling element 2. In one possible embodiment of the present application, the reservoir 9 may be filled completely or substantially completely with the cleaning fluid.

The cleaning and/or treating medium may then flow through the conduit 7 and through the flow meter 8 into the liquid channel 6. The sterilizing medium then may continue to flow through the opened liquid valve 13 into the channel 14.1 and into the control space 17, and then through the electrically controlled valve 25, into flow channel 23 and then into annular channel 26. Next the treating fluid may flow through the electrically operated valve 29 and into the annular channel 28, through the conduit 30 and control valve 31. The cleaning medium may then either be flowed back through the reservoir 9 or removed from circulation within the filling element 2, depending on the embodiment.

In at least one possible embodiment of the present application, the rinse plate 35 may be slid into place manually before cleaning of the filling machine, reservoir 9, and/or filling elements 2 on the rotor 4. In another possible embodiment, the rinse plates 35 may be inserted into place with respect to the dispensing opening 11 automatically. To automatically insert the plate 35, the rinse plate 35 may be rotated into place underneath the dispensing opening 11 and then lifted into sealing engagement against the dispensing opening 11 by suitable means.

Figure 4:
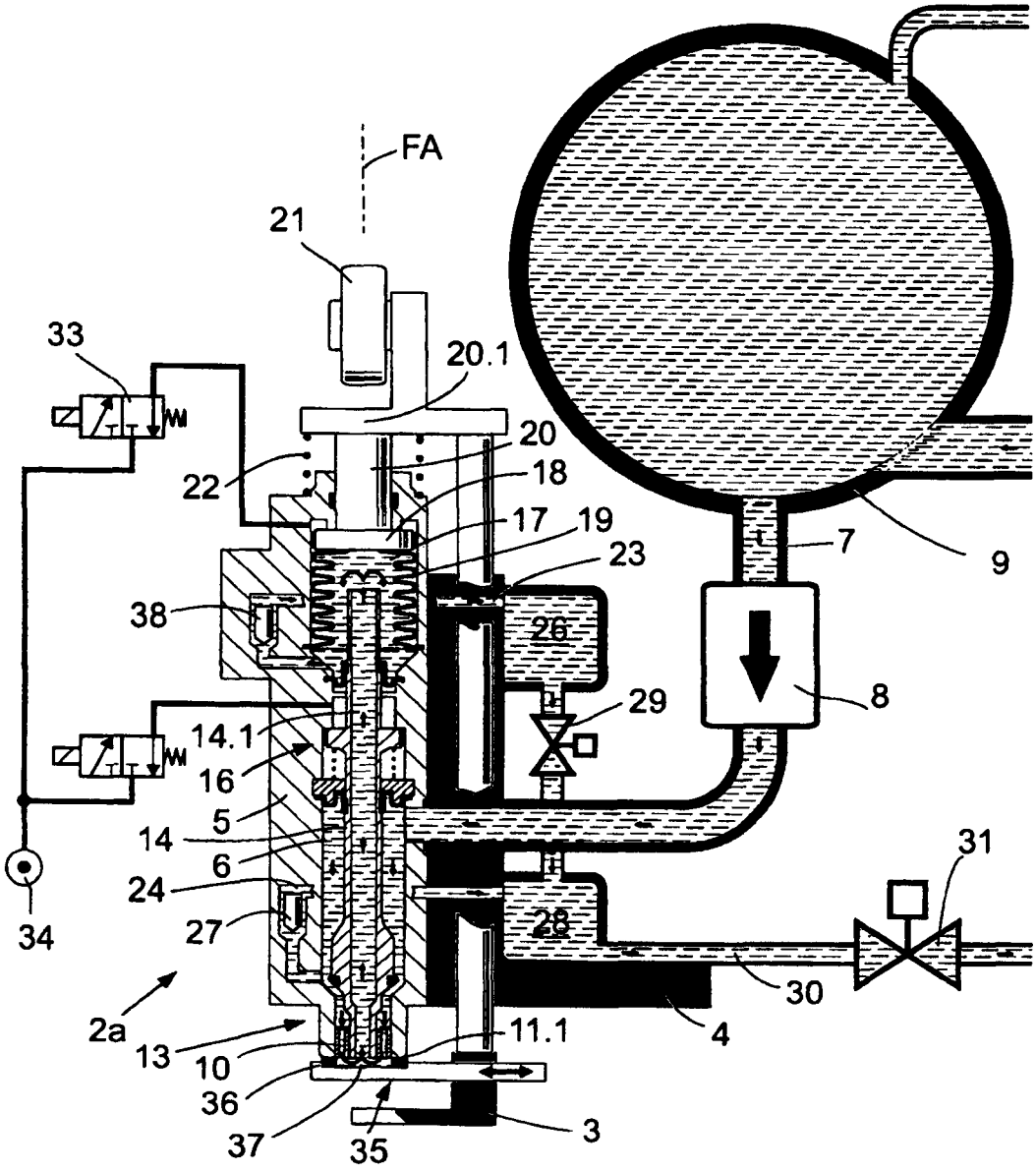
FIG. 4 shows a representation like FIG. 2, in another embodiment of the present application.

FIG. 4 shows, as a further embodiment, a filling element 2*a* which differs from the filling element 2 basically in that a check valve 38 is provided in the flow channel 23 instead of the electrically operated valve 25, which opens for a flow from the control space 17 into the annular channel 26, but closes for a flow in the opposite direction. The check valve 38 also prevents, restricts, and/or minimizes air from being aspirated with the liquid product emerging from the dispensing opening 11 during the filling via the pipe piece 14 or via the channel formed in this pipe piece, thus preventing an excessive frothing and/or an excessive inclusion of air and oxygen in the bottled product. The check valve 38 also makes possible the flow of cleaning or sterilization medium in the flow channel as well, which is needed and/or desired for the CIP cleaning and/or sterilization.

Figure 3:
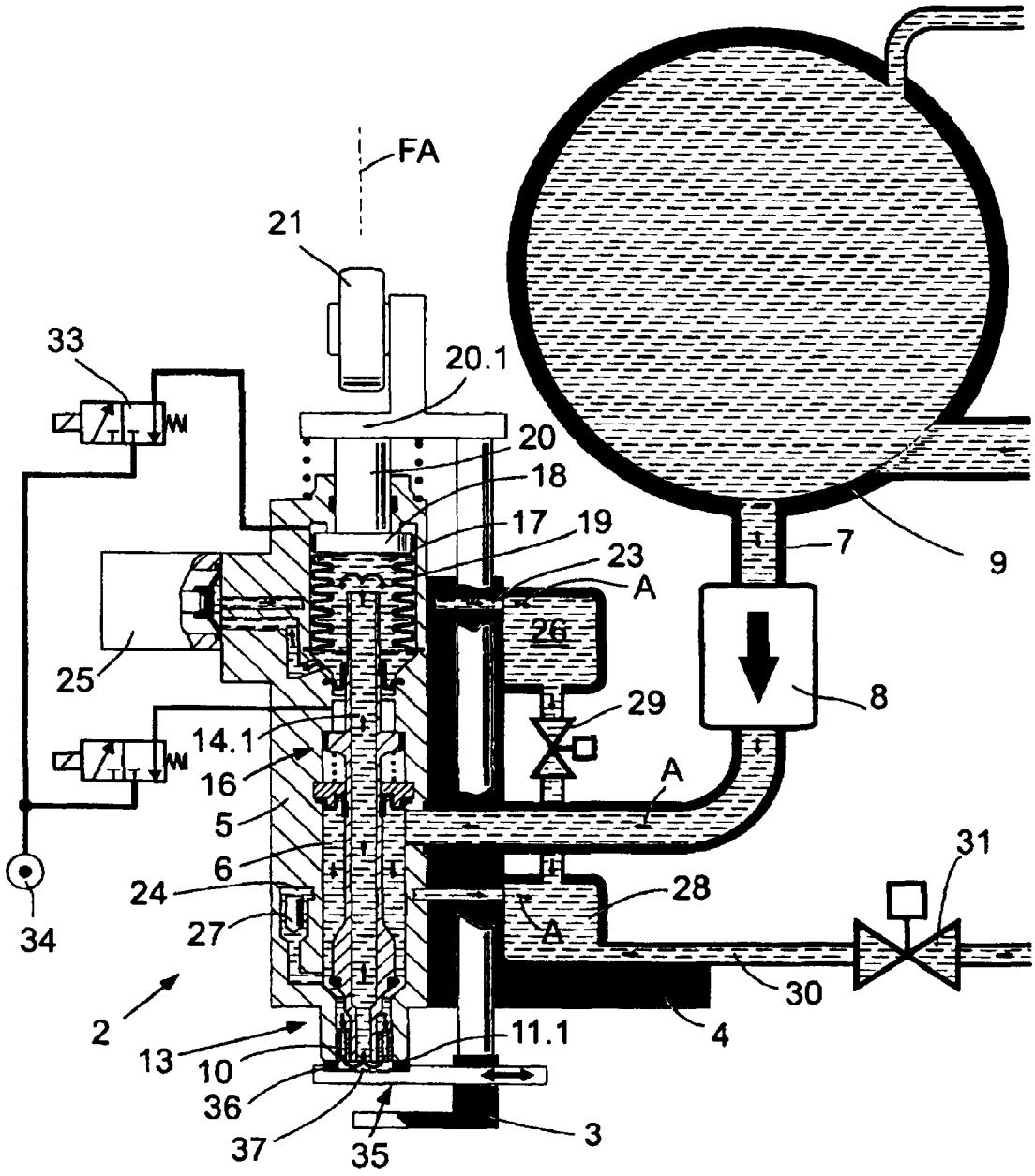
FIG. 3 shows a representation like FIG. 1, but in an operating state for a CIP cleaning and/or sterilization.
Figure 5:
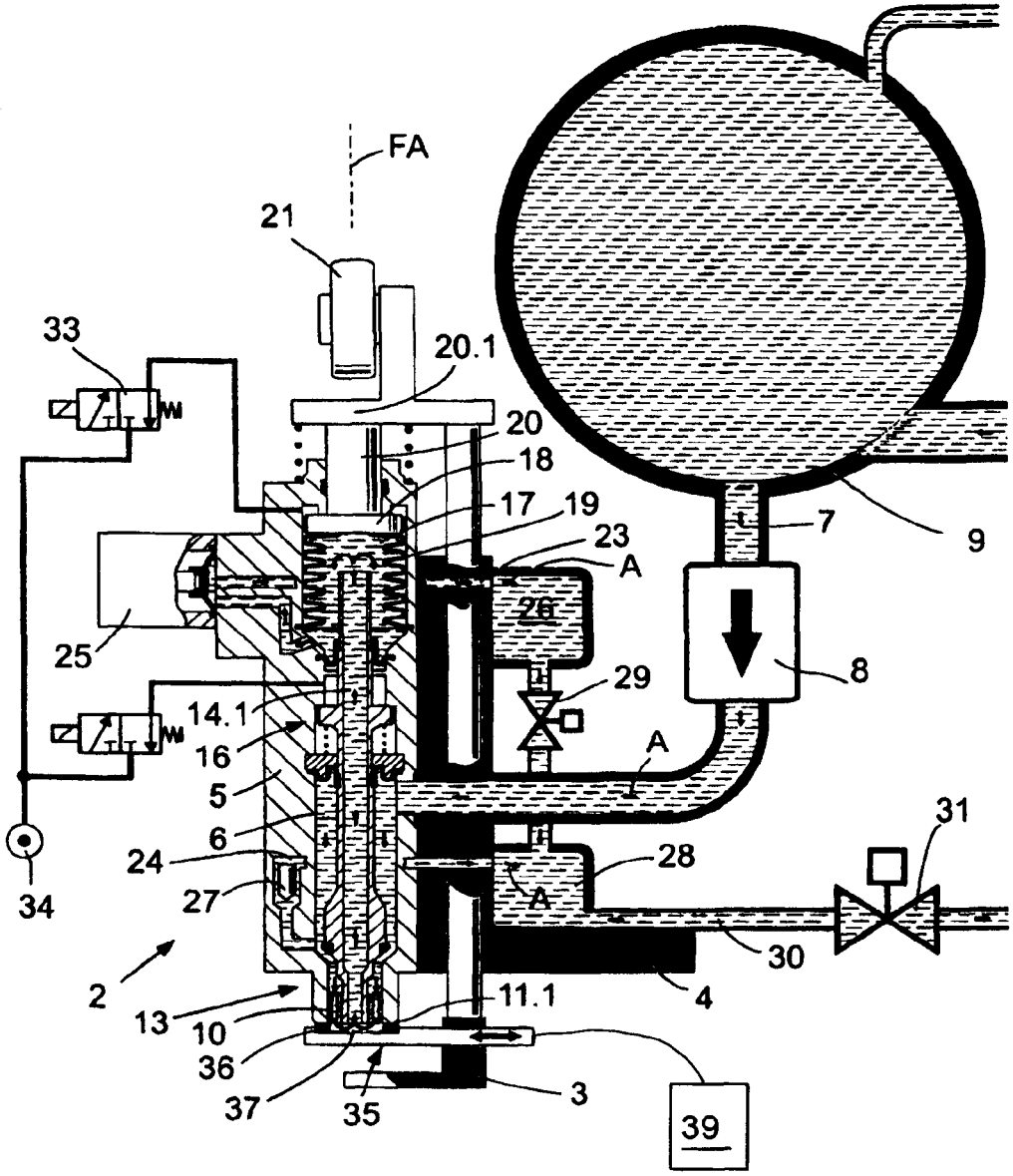
FIG. 5 shows a representation like FIG. 3 including a rotating and lifting arrangement.

FIG. 5 shows one possible embodiment of the filling element 2 of the present application, similar to the embodiment seen in FIG. 3. The filling element 2 of FIG. 5 also comprises a rotating and lifting arrangement 39 configured to rotate rinse plate 35 to a position underneath the dispensing opening 11 and then lift the rinse plate 35 into sealing engagement with the dispensing opening 11.

Figure 6:
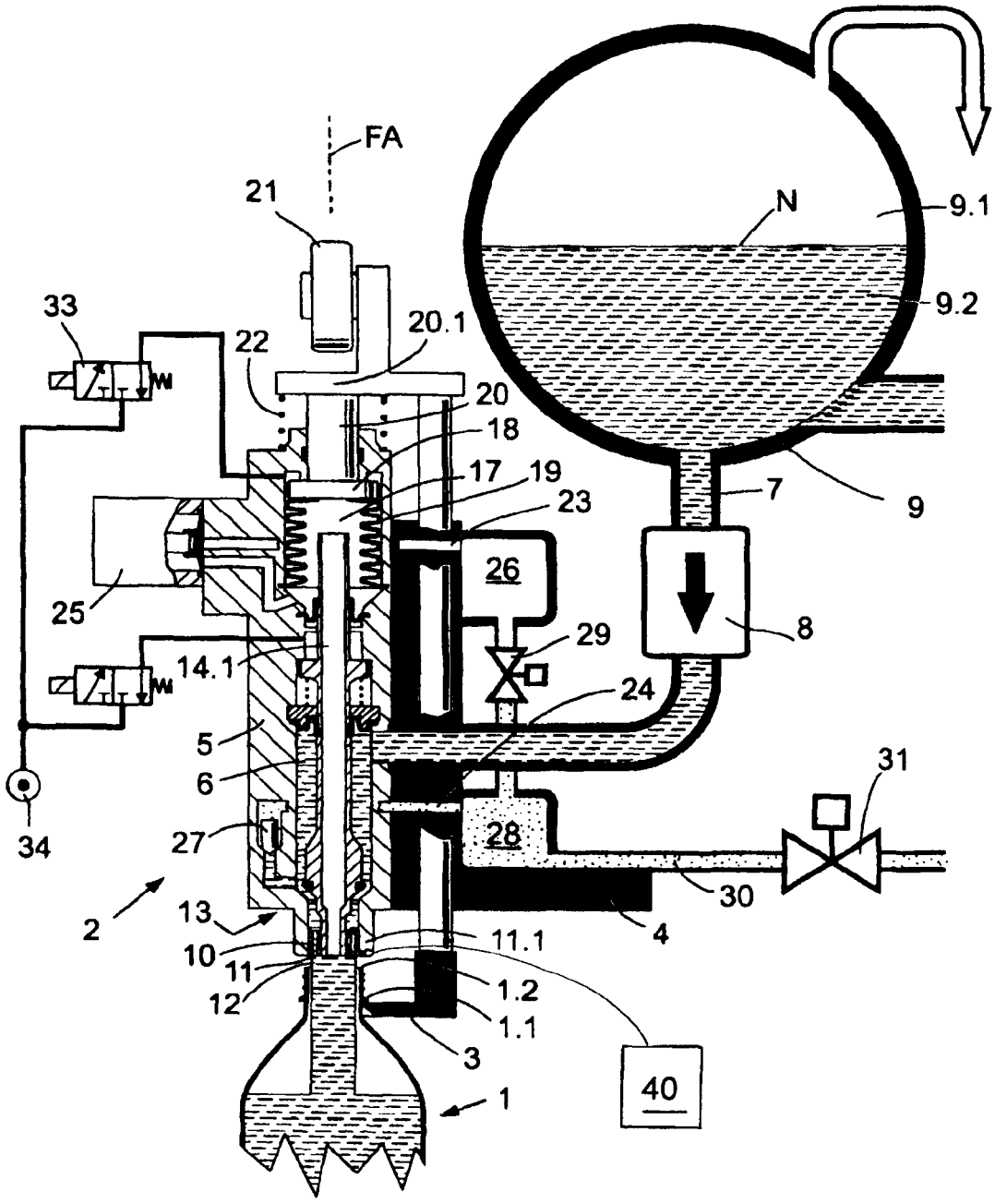
FIG. 6 shows a representation like FIG. 1 including a detector.

FIG. 6 shows one possible embodiment of the filling element 2 of the present application which additionally comprises a detector 40 disposed adjacent the dispensing opening 11. The detector 40 may be configured to detect the type of fluid being discharged from the dispensing opening 11. For example, after a cleaning or treating of the reservoir 9 and filling element 2 is completed, a beverage material may then be introduced into the reservoir 9, and that beverage material may flow through the liquid channel 6, through the liquid valve 13, and through the dispensing opening 11 into a container 1 through the container mouth 1.2. The detector 40 may be configured to detect if any residue of cleaning medium is present in the beverage material. The detector 40 may also be configured to detect how much residue of treating medium is present in the beverage material.

The present application has been described above by sample embodiments. Of course, changes and modifications are possible without leaving the underlying notion of the present application.

Free-stream filling system for filling of bottles or similar containers with a liquid product, having a filling element, whose housing has a liquid channel controlled by at least one liquid valve and forming at least one dispensing opening, in which is arranged at least one gas lock after the at least one liquid valve in the flow direction of the liquid product during the filling, and with a holder on which the closure element closing the dispensing opening for a cleaning and/or sterilization of the filling element is or can be fastened.

One feature or aspect of an embodiment is believed at the time of the filing of this patent application to possibly reside broadly in a free-stream filling system for filling machines for filling of bottles or similar containers 1 with a liquid product, having a filling element 2, in whose housing 5 is provided a liquid channel controlled by at least one liquid valve 13 and forming at least one dispensing opening 11, in which is arranged at least one gas lock 10 after the at least one liquid valve 13 in the flow direction of the liquid product during the filling and through which the liquid product flows during the filling, with a holder 3 on which a closure element 35 closing the dispensing opening 11 for a cleaning and/or sterilization operation is or can be secured, and also with means for pressing the closure element 35 against the filling element 2, wherein the means for pressing the closure element 35 are formed by a control element 18 with a control space 17 subjected to a fluid pressure, into which a fluid channel 14.1 empties that is open in the region of the dispensing opening 11, and at least a first controlled flow pathway is formed in the filling element housing 5, including the fluid channel 14.1 and the control space 17, which leads to a first collecting channel 26 in common to the filling elements 2 or several filling elements 2 of the filling machine and which can be closed during the filling operation and opened during the cleaning and/or sterilization operation.

Another feature or aspect of an embodiment is believed at the time of the filing of this patent application to possibly reside broadly in the filling system, wherein the control space 17 is bounded by at least one piston 18, movably guided in the housing 5, subjected to the pressure in the control space and connected to the holder 3.

Yet another feature or aspect of an embodiment is believed at the time of the filing of this patent application to possibly reside broadly in the filling system, wherein a controlling valve 25, 38 is provided in the first flow pathway or in a flow channel 23 of this flow pathway connecting the control space 17 to the first collecting channel 26.

Still another feature or aspect of an embodiment is believed at the time of the filing of this patent application to possibly reside broadly in the filling system, wherein the valve provided in the first flow pathway or flow channel 23 is a controlled valve 25 or a check valve 38, which opens for a flow into the first collecting channel 26 and closes for a flow in the opposite direction.

A further feature or aspect of an embodiment is believed at the time of the filing of this patent application to possibly reside broadly in the filling system, wherein the fluid channel 14.1 is formed in a valve plunger of the at least one liquid valve 13.

Another feature or aspect of an embodiment is believed at the time of the filing of this patent application to possibly reside broadly in the filling system, wherein the fluid channel 14.1 is formed in a pipe piece 14 in one possible embodiment forming the valve plunger of the at least one filling element 13.

Yet another feature or aspect of an embodiment is believed at the time of the filing of this patent application to possibly reside broadly in the filling system, wherein the fluid channel 14.1 is open in the region of the gas lock 10.

Still another feature or aspect of an embodiment is believed at the time of the filing of this patent application to possibly reside broadly in the filling system, comprising at least one second controlled flow pathway 24 in the filling element 5, which connects the liquid channel 6 upstream from the closed liquid valve 13 in the flow direction of the liquid product to a second collecting channel 28 in common for the filling elements 2 or for several filling elements 2 of the filling machine.

A further feature or aspect of an embodiment is believed at the time of the filing of this patent application to possibly reside broadly in the filling system, wherein the second flow pathway 24 is controlled such that it opens during the cleaning and/or sterilization operation and/or during a heating of the filling element 2 with the hot fill product for a flow from the liquid channel 6 into the second collecting channel 28.

Another feature or aspect of an embodiment is believed at the time of the filing of this patent application to possibly reside broadly in the filling system, wherein a check valve 27 is provided in the second flow channel 24, which opens for a flow from the liquid channel 5 into the second collecting channel 28, but closes for a flow in the opposite direction.

Yet another feature or aspect of an embodiment is believed at the time of the filing of this patent application to possibly reside broadly in the filling system, comprising a valve plunger end stop 18, which can move in controlled manner between an inactive position and an active position, and which in the active position limits the stroke of the valve plunger for a reduced opening of the liquid valve 13.

Still another feature or aspect of an embodiment is believed at the time of the filing of this patent application to possibly reside broadly in the filling system, wherein the valve plunger end stop 18 can move under pressure control, e.g., pneumatically, between its active and inactive position.

A further feature or aspect of an embodiment is believed at the time of the filing of this patent application to possibly reside broadly in the filling system, wherein the valve plunger end stop for the valve plunger reaching into the control space 17 or for the pipe piece 14 forming this valve plunger is formed by the piston 18 bounding off the control space.

One feature or aspect of an embodiment is believed at the time of the filing of this patent application to possibly reside broadly in the filling system, wherein the piston 18 forms at its side away from the control space 17 a control or cylinder space 32 subjected to a control pressure, in one possible embodiment an air pressure.

Another feature or aspect of an embodiment is believed at the time of the filing of this patent application to possibly reside broadly in the filling system, comprising at least one controlled valve 29 joining the first and second collecting channels 26, 28.

Yet another feature or aspect of an embodiment is believed at the time of the filing of this patent application to possibly reside broadly in the filling system, wherein the closure element 35 is movable to the holder 3, for example, it can move between a position of use and an idle position.

Still another feature or aspect of an embodiment is believed at the time of the filing of this patent application to possibly reside broadly in the filling system, wherein the closure element 35 is provided on a container holder 3.

A further feature or aspect of an embodiment is believed at the time of the filing of this patent application to possibly reside broadly in the filling system, wherein the closure element is a rinse plate 35, in one possible embodiment a rinse plate 35 with at least one sealing ring 36 which can be pressed against the filling element 2 and bounding the rinse space 37 at the sides.

Another feature or aspect of an embodiment is believed at the time of the filing of this patent application to possibly reside broadly in a method for control of a free-stream filling system according to the present application, wherein the first flow pathway 14.1, 17, 23 for the filling operation is closed for a flow from the first collecting channel 26.

Yet another feature or aspect of an embodiment is believed at the time of the filing of this patent application to possibly reside broadly in the method, wherein the first flow pathway 14.1, 17, 23 for the filling operation is closed at least for a flow from the first collecting channel 26 into the control space 17.

Still another feature or aspect of an embodiment is believed at the time of the filing of this patent application to possibly reside broadly in the method for control of a filling system according to the present application, wherein the first flow pathway 14.1, 17, 23 is opened, for the cleaning and/or sterilization operation with filling element 2 closed by the closure element 35 at the dispensing opening 11 and liquid valve 13 opened, at least for a flow of a cleaning and/or sterilization medium across the control space 17 into the first collecting channel 26, so that the closure element 35 is pressed by the pressure of the cleaning or sterilization medium in the control space 17 against the filling element 2.

A further feature or aspect of an embodiment is believed at the time of the filing of this patent application to possibly reside broadly in the method, wherein for the cleaning and/or sterilization operation the first collecting chamber 26 is connected to the second collecting chamber 28 for a flow of the cleaning and/or sterilization medium.

Another feature or aspect of an embodiment is believed at the time of the filing of this patent application to possibly reside broadly in the method, wherein during the cleaning and/or sterilization operation the cleaning or sterilization medium supplied to the liquid channel 6 flows at least through this liquid channel, the gas lock 10, the rinse chamber 37 bounded off by the closure element 35, the fluid channel 14.1, the control space 17 and the first flow channel 23 and is taken away through the first or second collecting channel 26, 28.

Yet another feature or aspect of an embodiment is believed at the time of the filing of this patent application to possibly reside broadly in the method, wherein during the cleaning and/or sterilization operation the cleaning or sterilization medium supplied to the liquid channel 6 also flows through the second flow pathway 24 and is taken away through the second collecting channel 28.

A further feature or aspect of an embodiment is believed at the time of the filing of this patent application to possibly reside broadly in a free-stream filling system for filling machines for filling of bottles or similar containers 1 with a liquid product, having a filling element 2, in whose housing 5 is provided a liquid channel controlled by at least one liquid valve 13 and forming at least one dispensing opening 11, in which is arranged at least one gas lock 10 after the at least one liquid valve 13 in the flow direction of the liquid product during the filling and through which the liquid product flows during the filling, with a holder 3 on which a closure element 35 closing the dispensing opening 11 for a cleaning and/or sterilization operation is or can be secured, and also with means for pressing the closure element 35 against the filling element 2, wherein the means for pressing the closure element 35 are formed by a piston 18 with a control space 17 subjected to a fluid pressure, in which a fluid channel 14.1 empties, whose opposite end extends as far as the region of the dispensing opening 11, where it ends open, and at least a first controlled flow pathway is formed in the filling element housing 5, including the fluid channel 14.1 and the control space 17, which leads to a first collecting channel 26 in common to all filling elements 2 or several filling elements 2 of the filling machine and which can be closed during the filling operation and opened during the cleaning and/or sterilization operation.

Another feature or aspect of an embodiment is believed at the time of the filing of this patent application to possibly reside broadly in the filling system, wherein the piston 18 forms at its side away from the control space 17, in conjunction with the peripheral wall of the control space 17 surrounding it and the upper end surface of the control space 17, a control or cylinder space 32 subjected to a control pressure, preferably an air pressure.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application.

Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Aug. 19, 2008, and/or cited elsewhere are hereby incorporated by reference as if set forth in their entirety herein as follows: EP 1,544,155, having the following English translation of the German title "BEVERAGE BOTTLING PLANT FOR FILLING BOTTLES WITH A LIQUID BEVERAGE, HAVING A FILLING ELEMENT AND THE FILLING MACHINE WITH SUCH ELEMENTS," published on Jun. 22, 2005; EP 1,580,160, having the following English translation of the German title "BEVERAGE BOTTLING PLANT FOR FILLING BOTTLES WITH A LIQUID BEVERAGE FILLING MATERIAL HAVING A FILLING DEVICE AND A FILLING MACHINE HAVING SUCH A FILLING DEVICE," published on Sep. 28, 2005; EP 1,571,119, having the following English translation of the German title "BEVERAGE BOTTLING PLANT FOR FILLING BOTTLES WITH A LIQUID BEVERAGE MATERIAL HAVING A FILLING ELEMENT AND A FILLING MACHINE HAVING SUCH FILLING ELEMENTS," published on Sep. 7, 2005; and WO 2007/118607, having the following English translation of the German title "BEVERAGE BOTTLING PLANT HAVING A FILLING MACHINE WITH MULTIPLE BEVERAGE FILLING ELEMENTS, A FILLING MACHINE WITH MULTIPLE BEVERAGE FILLING ELEMENTS, A FILLING ELEMENT AND RELATED METHOD," published on Oct. 25, 2007.

All of the patents, patent applications or patent publications, which were cited in the German Office Action dated Aug. 7, 2008, and/or cited elsewhere are hereby incorporated by reference as if set forth in their entirety herein as follows: DE 10 2004 015 167, having the following English translation of the German title, "BEVERAGE BOTTLING PLANT FOR FILLING BOTTLES WITH A LIQUID BEVERAGE FILLING MATERIAL HAVING A FILLING DEVICE AND A FILLING MACHINE HAVING SUCH A FILLING DEVICE," published on Nov. 3, 2005; DE 100 61 401, having the following English translation of the German title "Method and appliance for filling containers comprise filler elements, liquid path, and control valves," published on Jun. 13, 2002; DE 10 2004 004 331, having the following English translation of the German title "BEVERAGE BOTTLING PLANT FOR FILLING CONTAINERS, SUCH AS BOTTLES AND CANS, WITH A LIQUID BEVERAGE, A FILLING MACHINE FOR FILLING CONTAINERS WITH A LIQUID, AND A METHOD FOR FILLING CONTAINERS WITH THE FILLING MACHINE," published on Sep. 15, 2005; and DE 10 2004 017 205, having the following English translation of the German title "BEVERAGE BOTTLING PLANT FOR FILLING BOTTLES WITH A LIQUID BEVERAGE, HAVING A FILLING MACHINE WITH A ROTARY CONSTRUCTION FOR FILLING BOTTLES WITH A LIQUID BEVERAGE," published on Oct. 27, 2005.

Some examples of sterilizing or cleaning agents and concentrations thereof that may possibly be utilized or possibly adapted for use in at least one possible embodiment of the present application may possibly be found in the following: U.S. Pat. No. 6,039,922 issued to Swank et al. on Mar. 21, 2000; U.S. Pat. No. 6,244,275 issued to Ziegler et al. on Jun. 12, 2001; U.S. Pat. No. 6,406,666 issued to Cicla et al. on Jun. 18, 2002; and U.S. Pat. No. 6,612,149 issued to Wang et al. on Sep. 2, 2003.

Some examples of electric control valves that may possibly be utilized or possibly adapted for use in at least one possible embodiment of the present application may possibly be found in the following: U.S. Pat. No. 4,431,160 issued to Burt et al. on Feb. 14, 1984; and U.S. Pat. No. 4,609,176 issued to Powers on Sep. 2, 1986.

Some examples of control valve apparatus that may possibly be utilized or possibly adapted for use in at least one possible embodiment of the present application may possibly be found in the following: U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

Some examples of filling machines that utilize electronic control devices to control various portions of a filling or bottling process and that may possibly be utilized or possibly adapted for use in at least one possible embodiment of the present application may possibly be found in the following: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

U.S. patent application Ser. No. 10/931,817, having the title "Beverage bottling plant for filling bottles with a liquid beverage filling material, having an apparatus for exchanging operating units disposed at rotating container handling machines," and filed on Sep. 1, 2004, is herein incorporated by reference as if set forth in its entirety.

U.S. patent application Ser. No. 12/353,999, having the title "ROTARY BEVERAGE BOTTLE FILLING MACHINE CONFIGURED TO FILL BEVERAGE BOTTLES WITH DIFFERENT DIAMETERS, SIZES, AND SHAPES WITHOUT CHANGING BOTTLE CARRIERS AND A CONTAINER TREATMENT MACHINE CONFIGURED TO HANDLE CONTAINERS WITH DIFFERENT DIAMETERS, SIZES, AND SHAPES WITHOUT CHANGING CONTAINER CARRIERS," and filed on Jan. 15, 2009, is herein incorporated by reference as if set forth in its entirety herein.

U.S. patent application Ser. No. 12/564,290, having the title "FILLING SYSTEM FOR UNPRESSURIZED HOT FILLING OF BEVERAGE BOTTLES OR CONTAINERS IN A BOTTLE OR CONTAINER FILLING PLANT," and filed on Sep. 22, 2009, is herein incorporated by reference as if set forth in its entirety.

U.S. patent application Ser. No. 12/564,499, having the title "FILLING SYSTEM FOR HOT FILLING OF BEVERAGE BOTTLES OR CONTAINERS IN A BOTTLE OR CONTAINER FILLING PLANT," and filed on Sep. 22, 2009, is herein incorporated by reference as if set forth in its entirety.

Some examples of detectors, which may possibly be utilized or adapted for use in at least one possible embodiment of the present application, may possibly be found in the following: U.S. Pat. No. 7,609,054, having the title "Magnetic particle flow detector," published on Oct. 27, 2009; U.S. Pat. No. 7,608,460, having the title "Fluorescent pH detector system and related methods," published on Oct. 27, 2009; and U.S. Pat. No. 7,576,322, having the title "Non-contact detector system with plasma ion source," published on Aug. 18, 2009.

The patents, patent applications, and patent publication listed above in the preceding twelve paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2007 022 259.0, filed on May 9, 2007, having inventor Ludwig CLÜSSERATH, and DE-OS 10 2007 022 259.0 and DE-PS 10 2007 022 259.0, and International Application No. PCT/EP2008/003403, filed on Apr. 26, 2008, having WIPO Publication No. WO 2008/138472 and inventor Ludwig CLÜSSERATH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent application(s), that is, PCT/EP2008/003403 and German Patent Application 10 2007 022 259.0, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2008/003403 and DE 10 2007 022 259.0 from which this patent application claims priority which do not have to do with the correction of the translation in this patent application are not to be included in this patent application in the incorporation by reference.

Any statements about admissions of prior art in the original foreign patent applications PCT/EP2008/003403 and DE 10 2007 022 259.0 are not to be included in this patent application in the incorporation by reference, since the laws relating to prior art in non-U.S. patent Offices and courts may be substantially different from the patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

| AT LEAST PARTIAL NOMENCLATURE | |
|---|---|
| 1 | bottle |
| 1.1 | mouth flange |
| 1.2 | bottle mouth |
| 2, 2a | filling element |
| 3 | container holder |
| 4 | rotor |
| 5 | filling element housing |
| 6 | liquid channel in filling element 2 or 2a |
| 7 | conduit |
| 8 | flow meter |
| 9 | kettle |
| 9.1 | gas space |
| 9.2 | liquid space |
| 10 | gas lock |
| 11 | dispensing opening |
| 11.1 | annular edge surrounding the dispensing opening |
| 12 | stream |
| 13 | liquid valve |
| 14 | pipe piece |
| 14.1 | channel |
| 15 | valve body |
| 16 | activating element |
| 17 | control space |
| 18 | piston |
| 19 | bellows |
| 20 | piston rod |
| 20.1 | top end of piston rod 20 |
| 21 | cam roller |
| 22 | compression spring |
| 23, 24 | flow channel |
| 25 | control valve |
| 26 | annular channel |
| 27 | check valve |
| 28 | annular channel |
| 29 | controlled valve |
| 30 | conduit |
| 31 | controlled valve |
| 32 | cylinder space |
| 33 | control valve |

-continued

| AT LEAST PARTIAL NOMENCLATURE | |
|---|---|
| 34 | pressurized air source |
| 35 | rinse plate |
| 36 | sealing ring |
| 37 | rinse chamber or rinse space |
| 38 | check valve |
| A | flow of cleaning or sterilization medium during the CIP cleaning |
| FA | axis of filling element |
| N | level |

What is claimed is:

1. A container filling arrangement comprising:

a filling element comprising a liquid channel and a dispensing opening;

a closure element being configured to engage and close said dispensing opening;

a supply of cleaning and/or sterilization medium configured to supply cleaning and/or sterilization medium to said filling element during a cleaning and/or sterilizing operation; and a control element being operatively connected to said closure element and being actuatable, by fluid pressure of the cleaning and/or sterilization medium in said filling element, to increase the force of engagement of said closure element during the cleaning and/or sterilizing operation.

2. The container filling arrangement according to claim 1, wherein said filling element comprises a control space in which said control element is at least partly disposed, and which is configured to be pressurized to the fluid pressure of cleaning and/or sterilization medium in said filling element.

3. The container filling arrangement according to claim 2, wherein:

said container filling arrangement is a free-stream filling system and comprises a container holder configured to hold a container to be filled a distance from said dispensing opening;

said filling element comprises a housing in which is disposed said liquid channel;

said filling element comprises a liquid valve disposed in said liquid channel, and a gas lock disposed at said dispensing opening downstream of said liquid valve; and said gas lock is configured to permit liquid product to flow therethrough during filling of a container.

4. The container filling arrangement according to claim 3, wherein:

said closure element is secured or is configured to be secured to said holder;

said filling element comprises a fluid channel which is open at one end adjacent said dispensing opening, and is open at the other end to empty into said control space;

said container filling arrangement comprises a first collecting channel which is configured to be in common to a plurality of filling elements, and which is configured to be closed during a filling operation and opened during a cleaning and/or sterilization operation;

said filling element comprises a first controlled flow pathway formed in said housing; and said first controlled flow pathway connects said control space to said first collecting channel.

5. The container filling arrangement according to claim 4, wherein said control element comprises a piston configured to be movably guided in said housing and subjected to the pressure in said control space, which piston is operatively connected to said holder.

6. The container filling arrangement according to claim 5, wherein said filling element comprises a controlling valve disposed in said first flow pathway or in a flow channel of said first flow pathway.

7. The container filling arrangement according to claim 6, wherein said controlling valve is a controlled valve, or is a check valve which opens for a flow into said first collecting channel and closes for a flow in the opposite direction.

8. The container filling arrangement according to claim 7, wherein said liquid valve comprises a valve plunger, and said fluid channel is formed as a pipe piece in said valve plunger.

9. The container filling arrangement according to claim 8, wherein:

said fluid channel is open adjacent said gas lock;

said container filling arrangement comprises a second collecting channel which is configured to be in common to a plurality of filling elements; and said filling element comprises a second controlled flow pathway which connects said liquid channel to said second collecting channel at a point upstream from said dispensing opening.

10. The container filling arrangement according to claim 9, wherein said second flow pathway is configured to be opened during a cleaning and/or sterilization operation and/or during a heating of said filling element with a hot liquid product to permit flow from said liquid channel into said second collecting channel.

11. The container filling arrangement according to claim 10, wherein:

said filling element comprises a second flow channel which is part of said second flow pathway; and said filling element comprises a check valve disposed in said a second flow channel, which said check valve is configured to be opened for a flow from said liquid channel to said second collecting channel, and to be closed for a flow in the opposite direction.

12. The container filling arrangement according to claim 11, wherein said piston comprises a valve plunger end stop configured to be moved pneumatically between an inactive position and an active position in which the stroke of said valve plunger is stopped for a reduced opening of said liquid valve.

13. The container filling arrangement according to claim 12, wherein:

said piston forms at its side away from said control space a cylinder space configured to be subjected to a control pressure or a control air pressure; and said container filling arrangement comprises at least one controlled valve disposed to join said first and second collecting channels.

14. The container filling arrangement according to claim 13, wherein:

said closure element is movable between a position of use and an idle position;

said closure element is provided on said container holder; and said closure element is a rinse plate, or a rinse plate comprising at least one sealing ring configured to be pressed against said filling element bounding a rinse space at the sides.

15. A method of operating a container filling arrangement comprising the steps of:

engaging and closing a dispensing opening of a filling element using a closure element;

conducting cleaning and/or sterilization medium from a supply of cleaning and/or sterilization medium to said filling element and then through said filling element; and actuating, by fluid pressure of said cleaning and/or sterilization medium in said filling element, a control element operatively connected to said closure element, and thus increasing the force of engagement of said closure element during cleaning and/or sterilizing.

16. A method of operating a container filling arrangement according to claim 4, said method comprising closing said first flow pathway during a filling operation to prevent a flow from said first collecting channel.

17. A method of operating a container filling arrangement according to claim 4, said method comprising closing said first flow pathway during a filling operation at least to prevent a flow from said first collecting channel into said control space.

18. The method of operating a container filling arrangement according to claim 17, said method further comprising:

engaging and closing said dispensing opening of said filling element using said closure element;

opening said first flow pathway and opening said liquid valve;

running cleaning and/or sterilization medium through said liquid valve and into said control space; and actuating, by fluid pressure of said cleaning and/or sterilization medium in said control space, said control element operatively connected to said closure element, and thus increasing the force of engagement of said closure element during cleaning and/or sterilizing.

19. The method of operating a container filling arrangement according to claim 18, wherein:

said method further comprises flowing cleaning and/or sterilizing medium from said first collecting chamber into a second collecting chamber; and during the cleaning and/or sterilization operation the cleaning or sterilization medium supplied to said liquid channel flows at least through said liquid channel, said gas lock, a rinse chamber bounded off by said closure element, said fluid channel, said control space, and said first flow channel, and is taken away through said first or second collecting channel.

20. The method of operating a container filling arrangement according to claim 19, wherein during the cleaning and/or sterilization operation the cleaning or sterilization medium supplied to said liquid channel also flows through a second flow pathway and is taken away through said second collecting channel.

* * * * *